United States Patent [19]

Short

[11] 3,972,419

[45] Aug. 3, 1976

[54] FOOD SERVER

[76] Inventor: Junius Short, 3132 2nd St., New Orleans, La. 70125

[22] Filed: Dec. 9, 1974

[21] Appl. No.: 530,832

[52] U.S. Cl. ..... 211/78; 211/131

[51] Int. Cl.[2] ..... A47G 29/00

[58] Field of Search ..... 211/60 R, 60 M, 70, 211/77, 78, 128, 129, 131, 163; 220/23.2, 23.4, 23.83; 108/92, 94; D7/2, 4, 73, 74, 27, 38, 96, 140

[56] References Cited

UNITED STATES PATENTS

| | | | |
|---|---|---|---|
| 228,998 | 6/1880 | Johnston | 211/70 |
| 659,195 | 10/1900 | Best | 211/70 |
| 1,526,397 | 2/1925 | Thornton | 220/23.2 |
| 2,251,740 | 8/1941 | Konikoff | 211/131 |
| 2,879,507 | 3/1959 | Bonistall | 211/131 |
| 2,978,285 | 4/1961 | Jester | 211/131 |
| 3,269,683 | 8/1966 | Shinaver | 211/78 |
| D160,688 | 10/1950 | Brock | 211/78 |

FOREIGN PATENTS OR APPLICATIONS

| | | | |
|---|---|---|---|
| 711,884 | 6/1965 | Canada | 220/23.83 |
| 3,375 | 2/1893 | United Kingdom | 220/23.83 |

OTHER PUBLICATIONS

House Beautiful, Window Shopping, 1974.

*Primary Examiner*—Roy D. Frazier
*Assistant Examiner*—Robert A. Hafer
*Attorney, Agent, or Firm*—Pugh & Keaty

[57] ABSTRACT

A circular, rotatable food server of the "lazy Susan" type wherein the server has several types of removable, interchangeable trays with slotted holders for various associated utensils supported in radial array, a cover which may be placed over all trays, and platform sections which can be used to convert selected tray sections to raised platform sections. The server includes a base which moves on uni-directional base wheels. The upper utensil holder also serves as a container for catching any drippings or droppings from the operative ends of the utensils which contact the food as the upper utensil holder supports the utensils at a 45° angle. The radial length of the removable trays is substantially shorter than the radial length of the server to leave a substantial space of the order of an inch or two between the tips of the trays and the center of the server for easy grasping and removal of the trays.

12 Claims, 8 Drawing Figures

FOOD SERVER

BACKGROUND OF THE INVENTION

The present invention relates generally to a food server of the lazy Susan type used to dispense several different condiments or portions of food to a multitude of people.

Food servers have long been the object of much interest to people who regularly serve large groups of people. The food servers tend to localize the type of food being dispensed and several people may usually withdraw food simultaneously from multi-segmented compartments on the food servers.

The usual configuration of this type of food server is a lazy Susan type of food server wherein several pie shaped compartments are arranged around a central hub much as the spokes on a wagon wheel. This type of server is either picked up and spun by hand so that the proper food or condiment is placed adjacent to the party desiring same or the body of the server is free to rotate about a central hub on a bearing or bearings such that the entire server need not be lifted to spin the body or serving tray.

Typical examples of prior art food containers of the general circular configuration of the present invention are shown in the following patents:

| U.S. Pat. No. | Inventor(s) | Issue Date |
|---|---|---|
| 1,977,092 | L. H. Scurlock | October 16, 1934 |
| 1,978,695 | J. B. Clark | October 30, 1934 |
| 2,030,899 | L. H. Scurlock | February 18, 1936 |
| 2,042,637 | L. H. Scurlock | June 2, 1936 |
| 2,091,394 | T. S. Park | August 31, 1937 |

The use of spoons, forks, and other miscellaneous types of utensils for removing food from a lazy Susan type of food server is common. Typically, utensils are placed right in the food or condiment to be dispensed. The utensils are, however, subject to being displaced or even ejected from the server by centrifugal forces caused by rapidly spinning the body of the server.

The natural design of a round food dispenser lends itself to a round table of small size such that all persons when sitting around the table may reach the server with equal ease. The great majority of the tables in the country however are rectangular or elongated rather than round which causes difficulty to people unfortunate enough to be sitting on the long end of the table or at a corner.

The storing of condiments or food from one serving time to the next serving time presents a problem. Typically, the food will be removed from the food server by spooning it back into its original container and then washing the food tray itself. Washing the food tray is a problem in itself. If the food tray is large enough to hold a quantity of food, by necessity its diameter is very large. The large diameter of most existing serving trays necessitates hand washing as automatic dishwashers are not able to handle them.

The present invention is primarily concerned with overcoming these prior art problems by incorporating removable trays of all types in a decorative body with several ingenious features. The present invention in its preferred embodiment includes plastic or glass removable trays of several types, deep trays for storing larger quantities of food, shallow trays raised on supports for smaller quantities of food or condiments, and special purpose trays for holding salt, pepper, and other spices.

The present invention also includes a flat top which fits over all of the individual serving trays which can be used for storing the entire food server since all trays, whether shallow or deep, are the same height. The present invention also provides for utensils and utensil storage separate from the individual trays. The body of the food server itself serves as a support for the utensils, supporting them in inclined, radial array.

A further important feature of the invention is the use of parallel uni-directional wheels which will permit rolling in a back and forth or single direction only. This feature permits inter alia a long rectangular table to be served by a rotating, longitudinally traversing food server.

A still further important feature is the provision near the top of the device of an upper utensil support container which catches the drippings and droppings from the aperative, food contacting ends of the utensils and support them at a substantial incline of the order of 45°, which angle presents them at a convenient angle for grasping, enhances the drip catching action, and securely holds them against centrifugal action when the basic body of the food server is rotated.

Additionally, in the preferred embodiment of the present invention, the food holding tray inserts have a depth significantly less than the depth of the openings, leaving a space of the order of an inch or two at their inner tips allowing the tops to be easily grasped for easy removal and insertion of the inserts.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DESCRIPTION OF THE PREFERRED EMBODIMENT

Figure 1:
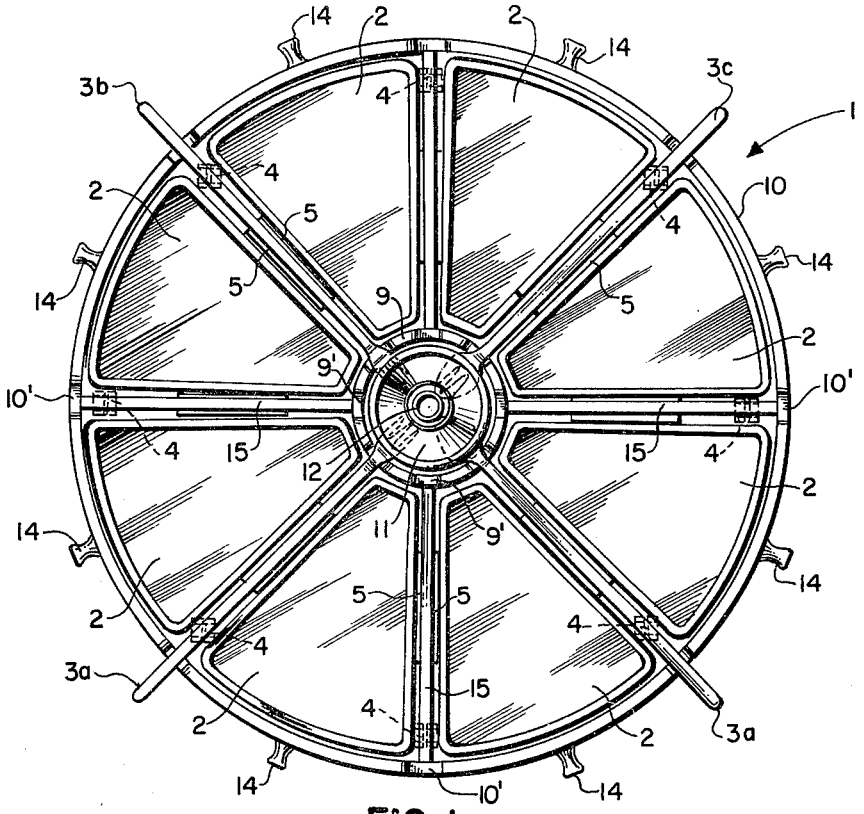
FIG. 1 is a plan view showing the individual serving tray locations and utensil layout of the preferred embodiment of the present invention.

As best shown in FIGS. 1–4, the preferred embodiment of the present invention comprises a rotating food server body 1, having several tray inserts 2 of different characteristics, holding its own utensils 3, covered by a cover 8 (note FIG. 4), and moving on uni-directional wheels 4.

Figure 2:
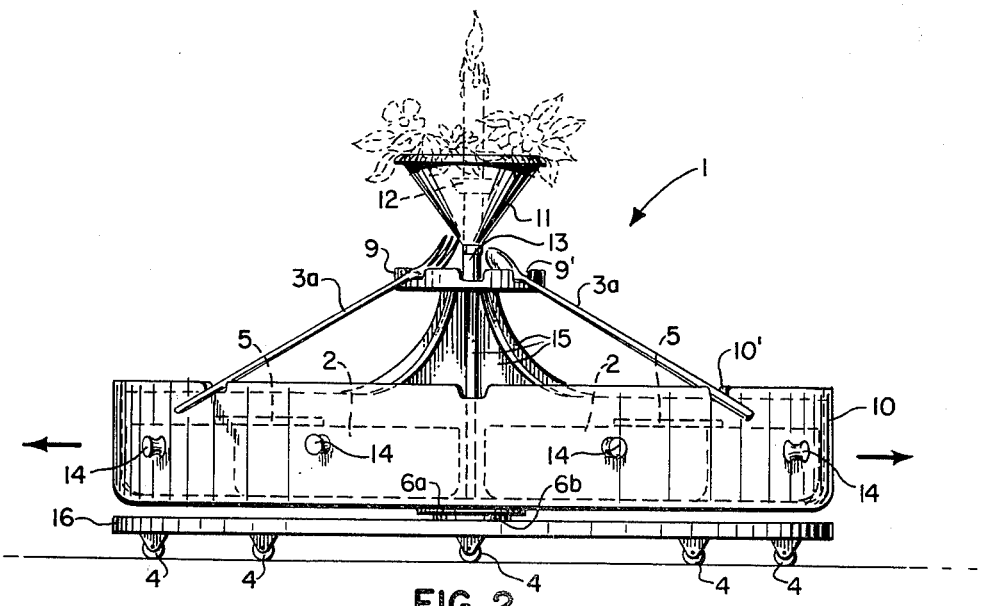
FIG. 2 is a side view of the embodiment of FIG. 1 showing the complete configuration of the server as well as movement of the uni-directional wheels.
Figures 3, 4, 5A, 5B, 5C, 5D:
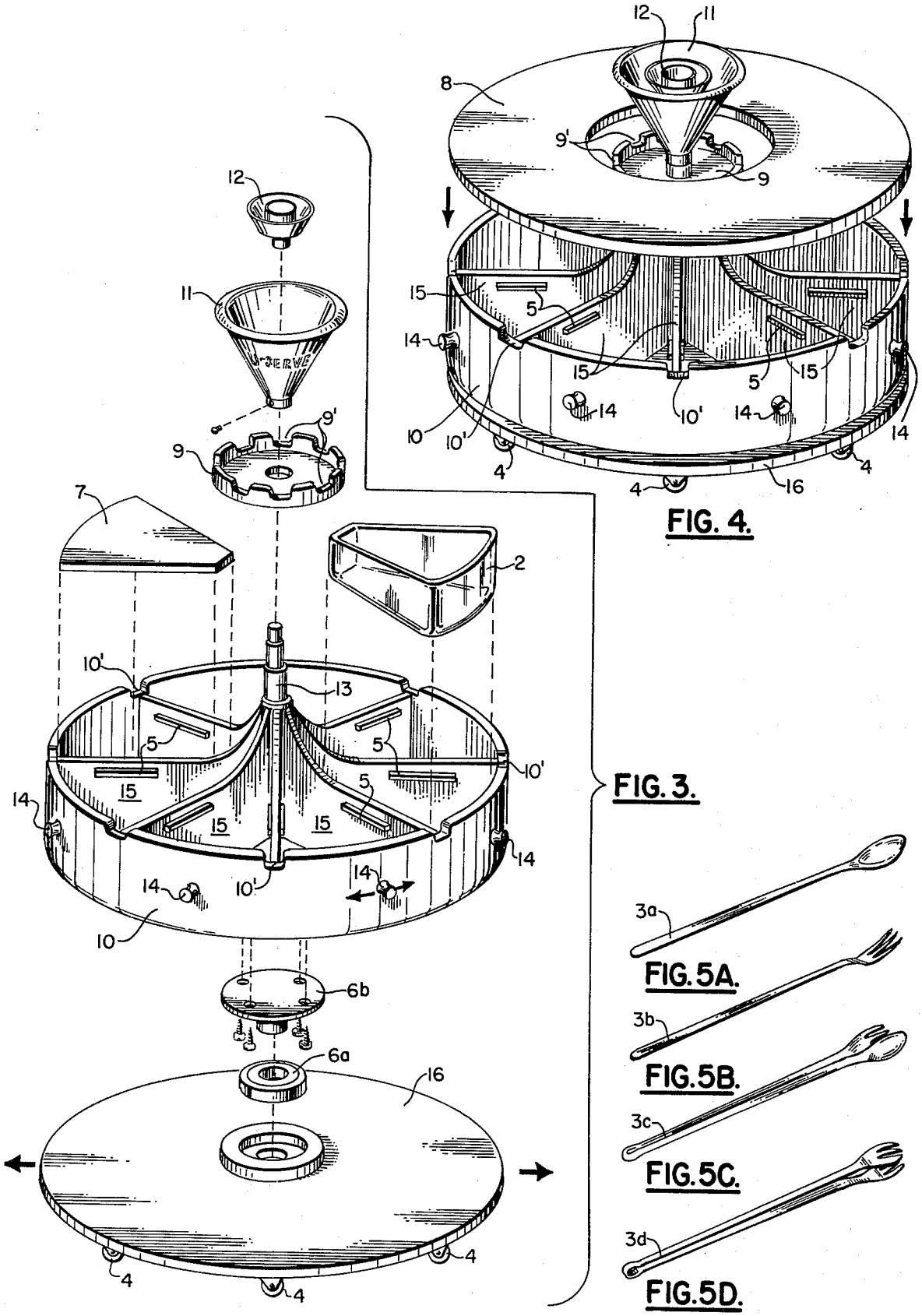
FIG. 3 is an exploded, assembly view of the preferred embodiment showing the bearing location, rotating body assembly, and vase assembly.
FIG. 4 is a perspective view of the food server with the cover being placed on it.
FIG. 5A is a perspective view of spoon used with the food server.
FIG. 5B is a perspective view of fork used with the food server.
FIG. 5C is a perspective view of a spoon-and-fork gripping type utensil used with the food server.
FIG. 5D is a perspective view of a double-fork gripping type utensil used with the food server.

The body 1, as shown in FIGS. 1, 2, 3, and 4 and more specifically FIG. 3, accepts several plastic or glass inserts 2 or elevated platform inserts 7 within the openings 15. The main body 1 also has provisions for holding the utensils 3 in inclined, radial array, as indicated in FIGS. 1 and 2, by utensil holders 9' and 10' (note FIG. 3). Body 1 is shaped so as to permit acceptance of circular cover 8 as shown in FIG. 4 for the complete covering of the tray receiving openings to form a continuous platform for the serving of desserts and the like around the center of the device.

Further, the body 1 is fastened to circular baseplate 16, note FIG. 3, by a rotating bearing structure comprising bearing 6*a* and upper bearing plate 6*b*. The circular baseplate 16 moves laterally on uni-directional wheels 4.

Body 1 has radial strips or ledges 5 in its openings defined by the radial vertical walls 15 which allow the use of different types of elevated platform inserts 7, so that the openings defined by the radial vertical walls 15 and the circular, vertical peripheral wall 10 can be used for purposes other than containing the glass or plastic tray inserts 2. A typical use of an elevated insert 7 would be for holding salt and pepper dispensers and the like (not illustrated).

The glass or plastic inserts 2 are shown as pie shaped segments, note FIG. 1, whereby each segment comprises approximately one-eighth of the total circumference of the food server.

The body 1 has provisions for six utensils 3 which are held firmly in place immediately adjacent to the serving inserts 2, 7 which hold the food or condiments to be served. The body 1 has a special utensil holder 9 designed to catch the droppings from the various utensils 3 after their use. The utensils are held firmly in place in inclined, radial array between notches 9' on the utensil holder 9 and notches 10' in the circular wall 10 of the main server body 1 at a preferred angle of 45°.

By rotating the main body 1, the selected food in its insert 2 with the appropriate utensil server 3 for the food is presented immediately adjacent to the party desiring the food. Handles or knobs 14 are provided along the peripheral wall 10 for grasping to rotate the main body 1.

Typical elongated serving utensils are illustrated in FIGS. 5*a*–5*d* wherein utensil 3*a* is a serving spoon, utensil 3*b* is a serving fork, utensil 3*c* is a combined spoon-and-fork gripping type utensil, and utensil 3*d* is a combined double-fork gripping type utensil.

For decorative purpose a cup shaped holder or vase 11 for flowers and the like (note phantom lined elements of FIG. 2) is provided on the central shaft 13 of the main body 1, as well as a candle holder 12. As illustrated in FIG. 3, the central shaft 13 is provided with stepped ledges having varying diameters which match the central apertures of the upper utensil holder 9, the vase 11 and the candle holder 12, with appropriate attachment means such as the set screw illustrated provided for holding them in place.

It is noted that all of the parts are designed to be easily disassembled for easy cleaning and can be made of a high temperature plastic capable of use in a dish washer.

It is further noted that the depth of the inserts 2, 7 are significantly less than the length of the radial walls 15 and hence the depth of the openings defined by the radial and peripheral walls 15 and 10, respectively, with the maximum width of the inserts 2, 7 designed to be almost equal to the maximum width of the defined openings. Thus, the inserts 2, 7 are positioned toward the outboard ends of the openings, thereby leaving a significant gap between its inner tip and the central shaft or post 13. This gap is preferably of the order of an inch or two to allow easy grasping of the inserts 2, 7 for insertion or removal of the inserts. The bottom of the pan inserts 2 could also be provided with projections or blips (not illustrated) at their bottom to raise the main body of the bottom of the inserts 2 off of the bottom of the defined openings for further ease in removal.

As seen especially in FIG. 1, the utensils 3 are radially supported directly over the radial walls 15 and hence do not interfere with easy and open access to the food contained on or in the inserts 2, 7, leaving the spaces above the confined openings completely open.

It is finally noted that, as seen in the drawings, the inner, central portions of the radial walls 15 project upward in a smooth curve which serves to strengthen the central post 13 and to properly centrally position the flat cover 8 as it is inserted over the top and down onto the top of the peripheral wall 10.

EXEMPLARY VARIATIONS OF THE PREFERRED EMBODIMENT

As required by the patent statutes, the structure and operation of the preferred embodiment of the present invention has been described in detail, however many variations of these details are possible within the scope of the present invention. Illustrative, but certainly not exhaustive, of these variations are the following.

Although the preferred embodiment employs uni-directional wheels, bi-directional or omni-directional wheels or casters may be used. The bearing which allows the food server body to rotate on its base could be modified or deleted permitting limited or no rotation of the server body or additional bearing elements could be provided out along the periphery of the structure for further support.

The number of sections or inserts could easily be varied from the preferred embodiment of the present invention which has eight sections. The number of utensils could be varied with the number of inserts either directly or proportionately.

The central shaft section could be diametrically enlarged so as to close off the opening between it and the tips of the tray and platform inserts, although the presence of such an opening allows for easy grasping of the inserts when it is desired to remove them from the server. If the opening were closed off, projecting means could be provided on the inserts for grasping purposes.

The cover could be solid as shown or perforated. The cover could be domed to permit covering of the entire food server including the utensil holders, decorative candle holders, etc. The platform inserts could be designed to include openings or depressions therein for mating with and more firmly holding the items being supported.

Having described the preferred embodiment of the invention and indicating a few of the many possible variations, what is claimed to be invention is:

1. A rotatable food server of the lazy-Susan type comprising:

a circular basic body having a bottom, a central post emanating vertically therefrom and a series of radial, vertical walls emanating from said central post and terminating in a circular, vertical, peripheral wall, thereby defining a series of triangularly shaped, confined openings for containing and holding food inserts;

a multiple number of triangularly shaped insert means for holding food for insertion in said openings; the length of said insert means being substantially less than the length of said radial walls, leaving a space of the order of an inch or two between the inner tip of said insert means and said central post, whereby said insert means can be easily grasped for the removal or the insertion of the inserts from and into said basic body;

an upper utensil holder located at least near the top of said central post;

a set of utensils supported in radial, inclined array about said central post and being held in place by means located in said peripheral wall of said body and in said upper utensil holder; and a base upon which said body is rotatably mounted on its upper side and having on its lower side a set of supports.

2. The food server of claim 1 wherein there is further included:

a flat, circular cover having a central aperture therein for placing said cover over and around said central post for covering all of said openings, said circular cover presenting an at least substantially flat upper surface upon which food items such as desserts on saucers can be supported for display thereof.

3. The food server of claim 1 wherein there is further included:

an upper utensil holder located at least near the top of said central post; and a set of utensils each having a wider dimension at its operative end supported in radial, inclined array about said central post and being held in place by notches located in said peripheral wall of said body and in said upper utensil holder.

4. The food server of claim 1 wherein said supports for said base are uni-directional wheels permitting movement only back and forth laterally in a straight line.

5. The food server of claim 3 wherein said utensils are supported at an incline of approximately 45°.

6. The food server of claim 3 wherein said upper utensil holder comprises a circular container means having a peripheral wall in which said utensil notches are located and a bottom for catching any drippings from the operative ends of said utensils when supported by said holder.

7. The food server of claim 3 wherein there is included a circular inverted-cone-shaped container for flowers, mints or the like positioned at the top of said central post above said circular utensil holder.

8. The food server of claim 1 wherein there is further included a series of knob means projecting horizontally out from said peripheral wall of said basic body disposed about the complete circumference of wall for grasping and rotatably turning said basic body and its contents about said base.

9. The food server of claim 3 wherein said utensils are supported directly over said radial walls, leaving the spaces over said confined opening completely open.

10. A rotatable food server of the lazy-Susan type comprising:

a circular basic body having a bottom, a central post emanating vertically therefrom and a series of radial, vertical walls emanating from said central post and terminating in a circular, vertical, peripheral wall, thereby defining a series of triangularly-shaped, confined openings for containing and holding food inserts, at least two, opposed radial walls including projecting support ledges along a substantial length thereof near their tops;

a multiple number of triangularly shaped insert means for holding food for insertion in said openings, at least one of said triangularly shaped insert means being in the form of a platform which is supportable by said ledges; and a base upon which said body is rotatably mounted on its upper side and having on its lower side a set of supports.

11. The food server of claim 10 wherein there is further included:

a flat, circular cover having a central aperture therein for placing said cover over and around said central post for covering all of said openings, said circular cover presenting an at least substantially flat upper surface upon which food items such as desserts on saucers can be supported for display thereof.

12. A rotatable food server of the lazy-Susan type comprising:

a circular basic body having a bottom, a central post emanating vertically therefrom and a series of radial, vertical walls emanating from said central post and terminating in a circular, vertical, peripheral wall, thereby defining a series of triangularly shaped, confined openings for containing and holding food inserts, at least two opposed radial walls including projecting support ledges along a substantial length thereof near their tops;

a multiple number of triangularly shaped insert means for holding food for insertion in said openings, the length of said insert means being substantially less than the length of said radial walls, leaving a space between the inner tip of said insert means and said central post, whereby said insert means can be easily grasped for the removal or the insertion of the inserts from and into said basic body; at least one of said triangularly-shaped insert means being in the form of a platform which is supportable by said ledges;

an upper utensil holder located near the top of said central post;

a set of utensils each having a wider dimension at its operative end supported in radial, inclined array about said central post and being held in place by notches located in said peripheral wall of said body and in said upper utensil holder, said utensils being supported at an incline of approximately 45° and being supported directly over aid radial walls, leaving the spaces over said confined openings completely open, and said upper utensil holder comprising a circular container means having a peripheral wall in which said utensil notches are located and a bottom for catching any drippings from the operative ends of said utensils when supported by said holder;

a circular inverted-cone-shaped container for flowers, mints or the like positioned at the top of said central post above said circular utensil holder;

a series of knob means projecting horizontally out from said peripheral wall of said basic body disposed about the complete circumference of wall for grasping and rotatably turning said basic body and its contents about said base; and a base upon which said body is rotatably mounted on its upper side and having on its lower side a set of uni-directonal wheels permitting movement only back and forth laterally in a straight line.

* * * * *

UNITED STATES PATENT AND TRADEMARK OFFICE

CERTIFICATE OF CORRECTION

PATENT NO. : 3,972,419

DATED : August 3, 1976

INVENTOR(S) : Junius Short

It is certified that error appears in the above-identified patent and that said Letters Patent are hereby corrected as shown below:

Claim 12, line 49, the word "aid" should be "said".

Signed and Sealed this

Ninth Day of November 1976

[SEAL]

*Attest:*

RUTH C. MASON
*Attesting Officer*

C. MARSHALL DANN
*Commissioner of Patents and Trademarks*